United States Patent [19]

Richards

[11] 4,122,952

[45] Oct. 31, 1978

[54] PHOTOMETRIC SORTERS

[75] Inventor: Arthur W. Richards, Bulleen, Australia

[73] Assignee: Sphere Investments Limited, Nassau, The Bahamas

[21] Appl. No.: 733,843

[22] Filed: Oct. 19, 1976

[30] Foreign Application Priority Data

Apr. 26, 1976 [AU] Australia ..... 2481/76

[51] Int. Cl.[2] ..... B07C 5/342

[52] U.S. Cl. ..... 209/579; 209/585; 209/587

[58] Field of Search ..... 209/73, 74 R, 74 M, 209/111.5, 111.7 R

[56] References Cited

U.S. PATENT DOCUMENTS

| | | | |
|---|---|---|---|
| 3,545,610 | 12/1970 | Kelly et al. | 209/111.7 R X |
| 3,901,388 | 8/1975 | Kelly | 209/111.7 R |
| 3,977,526 | 8/1976 | Gordon et al. | 209/111.7 R |

*Primary Examiner*—Joseph J. Rolla

*Attorney, Agent, or Firm*—Cushman, Darby & Cushman

[57] ABSTRACT

In the photometric sorting of objects each object is examined in each of a predetermined number of zones for the presence or absence of one or more predetermined surface characteristics. The invention provides that a characteristic determined in one zone be attributed to at least one other zone into which the object extends.

9 Claims, 6 Drawing Figures

PHOTOMETRIC SORTERS

This invention relates to photometric sorting.

In one system of photometric sorting an array of randomly distributed objects, for example ore bearing rocks, is moved on a conveyor past an optical or similar scanning system which illuminates the objects and determines the presence of surface characteristics by means of suitable detectors such as photomultipliers. The conveyor belt constitutes a sorting area which is divided into a number of electronic channels which stretch across the width of the belt and when an object with desirable surface characteristics is detected in one of the channels an air blast nozzle normally located near a discharge point of the belt is actuated to force the object to a collecting bin. Usually one nozzle is provided for each channel and is operable only on objects in that channel. No problems arise in the operation of this system when an object falls squarely within only one channel. Problems do arise however when the objects are relatively large and extend into at least two channels. In the first instance if the presence of a desirable surface characteristic is detected in only one channel and the object extends across two or more channels, only one nozzle will be actuated and the resultant force exerted by the air pressure is generally insufficient to force the object to the collecting bin. Secondly certain objects are selected not merely on the presence of one distinct surface feature but on the simultaneous presence of two or more contrasting surface features. It may thus happen that each of these features occurs in a separate channel and since the discriminating circuitry which selects the object is responsive to the features in one channel only, such object will not normally be selected.

It is an object of the present invention to provide a method of categorizing an object which substantially overcomes the above difficulties.

It is a further object of the present invention to provide improved apparatus for categorizing an object.

According to the invention, in the sorting of an object which extends into at least two predetermined zones a method of categorizing the object comprises examining the object in each of the zones for at least one predetermined characteristic and when the characteristic is detected attributing the characteristic to the object in a zone which lies on a first side of the zone in which the characteristic is detected when the distance between at least one point on the object in the zone and the point at which the characteristic is detected exceeds a predetermined amount, and attributing the characteristic to the object for all zones into which the object extends on a second side of the zone in which the characteristic is detected.

Further, in the sorting of an object which extends into at least two predetermined zones the invention provides apparatus for categorizing the object which comprises means for examining the object in each of the zones for at least one predetermined characteristic, means for determining the distance between the point at which the characteristic is detected and at least one point on the object in a zone which lies on a first side of the zone in which the characteristic is detected, and means for extending the characteristic to the object in that zone when the distance exceeds a predetermined amount, and for extending the characteristic to the object for all zones into which the object extends on a second side of the zone in which the characteristic is detected.

In one form of the invention each zone is quantized into a predetermined number of spaced regions and the apparatus of the invention includes means to generate a first series of signals corresponding to the regions into which the object extends, means to generate a second series of signals corresponding to the regions in which the predetermined characteristic is detected, means to compare the two sets of signals to produce a reference signal, and means responsive to the reference signal to attribute the characteristic to predetermined regions into which the object extends.

The invention is further described with reference to the accompanying drawings in which:

FIG. 4 is a plan view of an ore particle;

Figure 1:
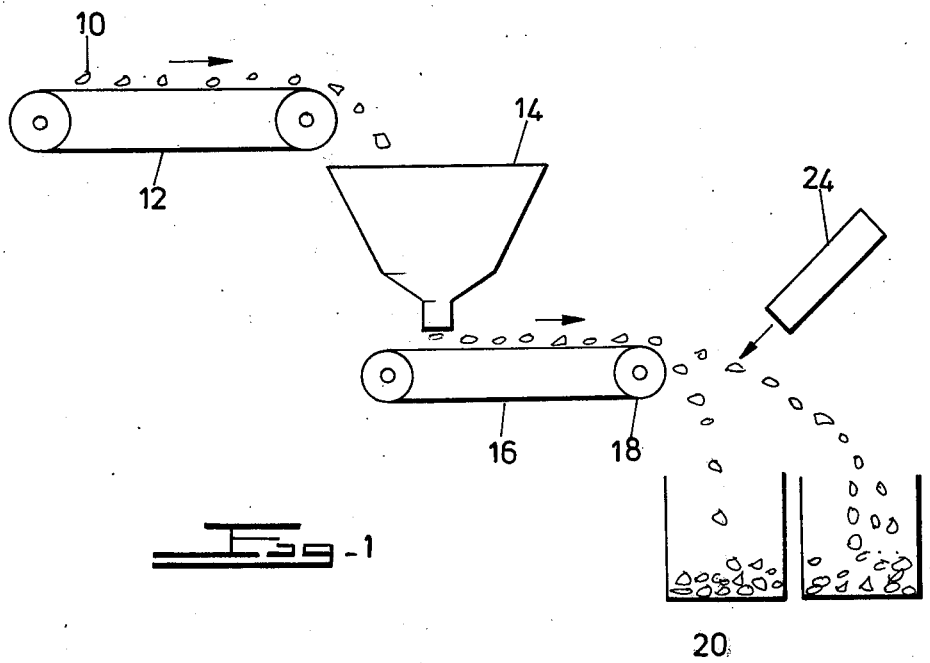
FIG. 1 is a schematic elevation of a photometric sorter for the sorting of ore.

FIG. 1 illustrates the general principle of photometric sorting. Ore particles 10 conveyed on an endless conveyor 12 are discharged into a hopper 14 and transferred at a predetermined rate to an endless conveyor 16. The particles are projected from the surface of the conveyor at one of its ends 18 to fall into one of two bins 20 or 22. At the base of each of the bins a conveyor belt (not shown) removes collected particles. Particles are analysed during their free fall by means of a photometric scanning system 24 and suitable particles are deflected into one of the bins by means of an array of air nozzles (not shown) which are operated in accordance with the surface characteristics of the particles as determined by the scanner.

Figure 2:
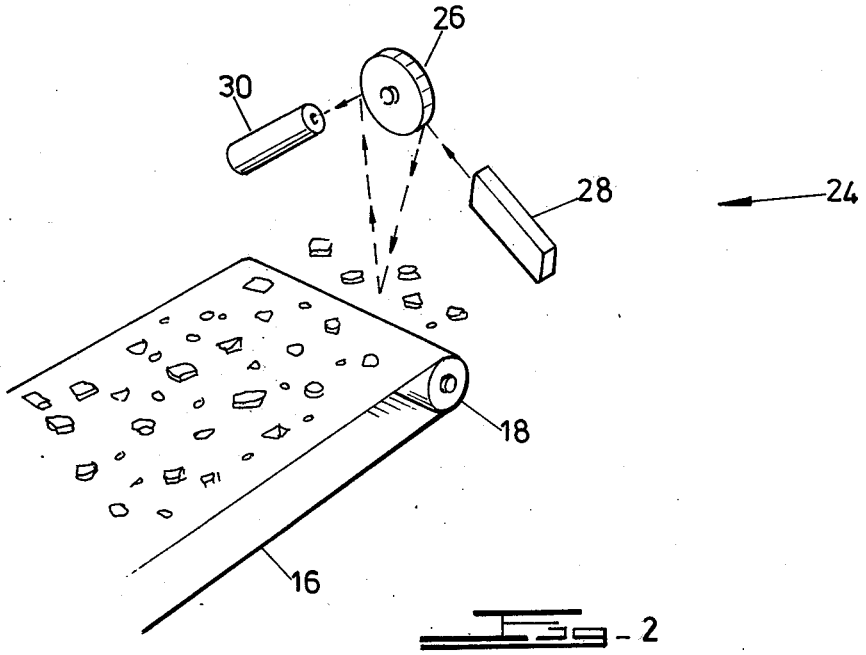
FIG. 2 is a perspective of photometric scanning apparatus.

FIG. 2 illustrates in more detail the scanner of FIG. 1. The scanner comprises a rapidly rotating multifaceted cylindrical mirror 26, a laser source 28 and a photomultiplier detector 30. The arrangement is such that each object is illuminated at least once during its fall from the belt end. Additional electronic circuitry is connected to the output of the photomultiplier to analyse the reflected signals transmitted from the ore particles to the photomultiplier.

Figure 3:
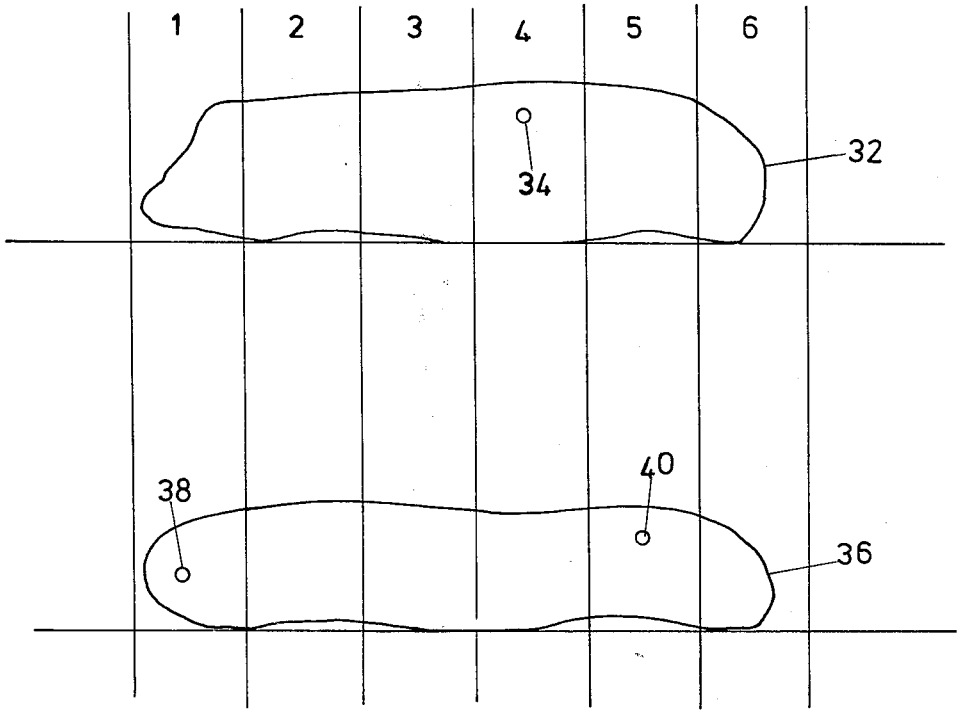
FIG. 3 is a plan view of an ore particle.

FIGS. 3 and 4 illustrate the two major problems which arise in categorizing ore particles in conventional sorters. The conveyor belt 16 of FIGS. 1 and 2 is divided into a number of imaginary electronic parallel channels, six of these channels being shown in FIGS. 3 and 4. The channels extend from the belt end 18 to the bins 20 and 22 for in fact the particles are scanned while in free flight. The channels are normally considered as separated entities and the sorter system functions adequately when a particle falls wholly within the confines of any one channel. FIG. 3 illustrates the situation which arises when an ore particle 32 extends over more than one channel and a desirable feature 34 is present in only one of the channels. In this case the air nozzle allocated to channel 4 will be actuated but the nozzles allocated to channel 4 will be actuated but the nozzles allocated to channels 1 to 3 and 5 and 6 will not be actuated. The air blast is therefore unlikely to have sufficient force to deflect the relatively large particle during its free flight.

FIG. 4 illustrates a second type of problem which arises when an ore particle 36 is selected by determining the presence of two desirable contrasting features 38 and 40. If these features 38 and 40 were present in the same channel the optical system would respond to them. However, when the features are located in separate channels the system has no way of knowing that the two features relate to one single ore particle and a particle of this type is therefore wrongly rejected by the system.

Figure 5:
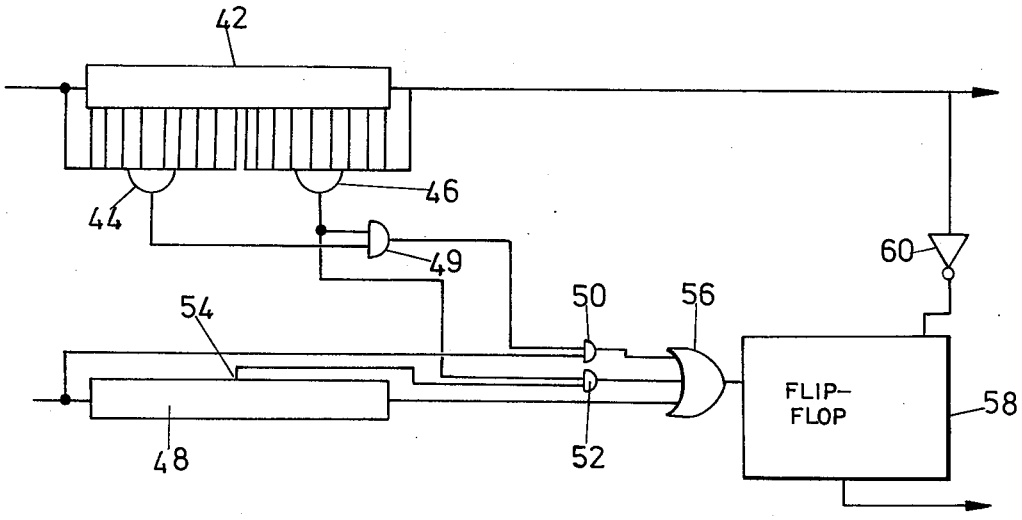
FIG. 5 is a circuit diagram of apparatus according to the invention for categorizing an object.

The circuit of FIG. 5 shows apparatus according to the invention for categorizing an ore particle. The apparatus comprises a first twenty bit shift register 42, the first ten bits being fed to a logical AND gate 44, the second ten bits being fed to a logical AND gate 46, and a second twenty bit shift register 48. The outputs from the two AND gates 44 and 46 are fed to a third AND gate 49, the output from this AND gate going to a fourth AND gate 50. The input to the shift register 48 is also connected to the AND gate 50. The output from the AND gate 46 is fed to an AND gate 52, a second input to this AND gate being derived from the tenth bit 54 in the shift register 48. The output from the shift register 48 and the outputs from the AND gates 50 and 52 are fed to a logical OR gate 56 which in turn is connected to one trigger of a flip flop 58. The output of the shift register 42 is fed via an inverter 60 to a second trigger of the flip flop 58.

Figure 6:
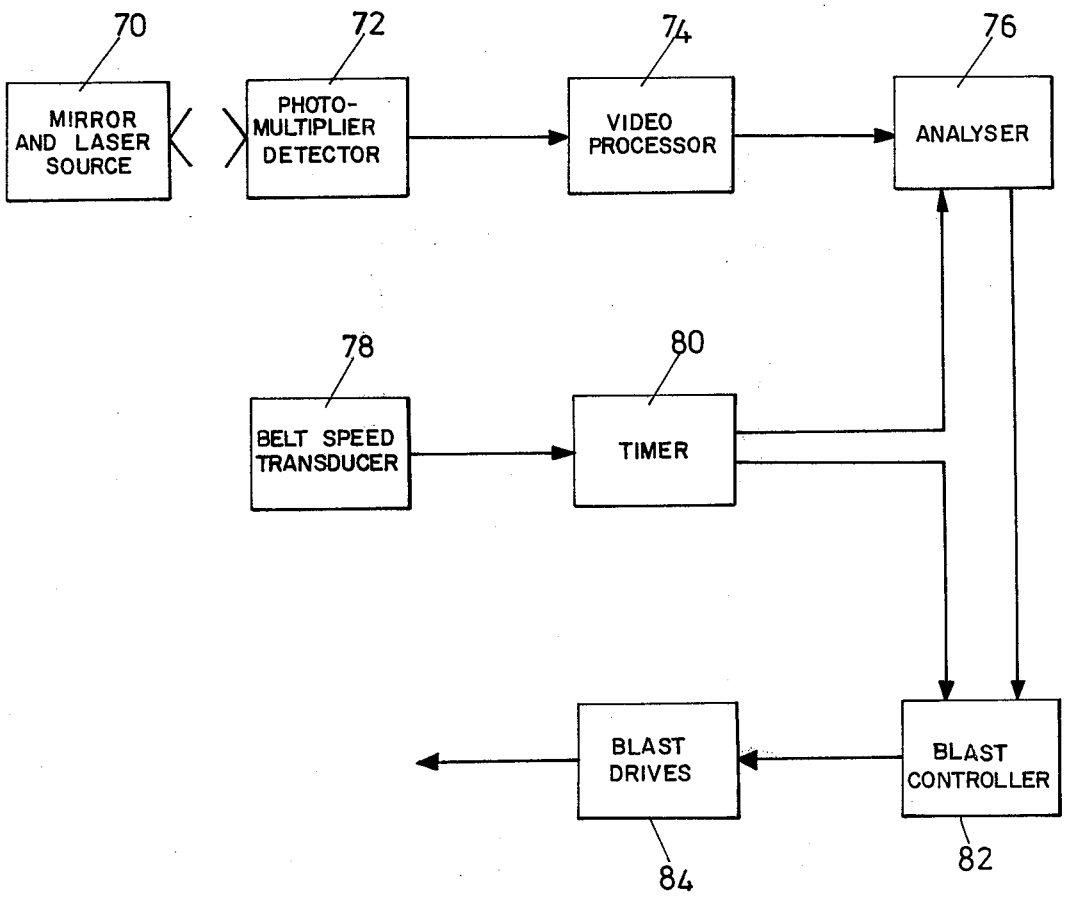
FIG. 6 is a block diagram of electronic apparatus used in a sorter.

FIG. 6 illustrates in block diagram form a system for processing signals from the scanning apparatus, and for controlling the air blast nozzles which are actuated to deflect the ore particles.

The mirror 26 and the laser source 28 are represented by the block 70 and the photomultiplier detector by the block 72. Signals from the photomultiplier are fed to a video processor 74 which is connected to an analyser 76. The speed of the belt 16 is measured by a suitable transducer 78 and is fed to a timing device 80. Output signals from the timing device 80 are fed to the analyzer 76 and to a blast controller 82. The controller 82 actuates blast drives 84 which in turn supply the various nozzles at the belt end 18 with air.

Briefly the system functions by illuminating the ore particles during free flight from the belt end 18 by means of the mirror and laser combination. Light reflected from the particles is detected by the photomultiplier 72 and processed by the video processor 74 to generate two sets of pulse. The first set indicates the presence and position of desirable surface features on the various particles and the second set indicates the boundaries of the various particles. This information is fed to the analyser 76 which takes into account the belt speed and the positions and trajectories of the free falling particles to compute which nozzles are to be actuated and the instants in time at which they are to be actuated. The analyser 76 and the timing device 80 thus set the blast controller 82 which causes the desired blast drives 84 to be actuated at the computed instants.

The circuit of FIG. 5 provided by the invention now forms part of the video processor 74. Its function is to modify the usual processing of video information fed to the processor 74, and its output is fed directly to the analyser 76.

The apparatus of FIG. 5 is clocked at a rate determined amongst other things by the speed of the conveyor belt 16 and the speed of rotation of the mirror 26. The clock rate is such that the beam of light from the laser reflected on to the conveyor belt by the mirror traverses one channel during ten clock pulses. The light from the mirrow is directed on the ore particles when they are in free fall. The background to the particles is what is known as black space and is for practical purposes totally non-reflective. Thus in the first instance the photomultiplier is able to detect the boundaries of an ore particle and secondly it is able to detect the presence of one or more desirable surface characteristics. The information obtained from the photomultiplier via the analysing circuitry when the light from the mirror traverses an ore particle from one boundary to another is presented to the shift register 42 as a series of pulses of uniform ampliutde, ten consecutive pulses indicating that the particle extends over one channel width. Desirable features on the surface of the particles are indicated by significant changes in reflectivity and these features are detected by window comparators which are set for particular reflectivity levels, a window comparator for each feature to be detected, and a shift register 48 for each window comparator. The presence of a desirable surface feature is indicated by a single pulse, the width of the pulse being proportional to the width of the surface feature. The pulses corresponding to the surface features are fed to the shift register 48. The flip flop is triggered by a positive output appearing at either of the AND gates 50 or 52, or at the output of the shift register 48.

Data which is presented to the shift register 48 is simultaneously presented to the AND gate 50 and is logically ANDED with the output of the AND gate 49. In practice this means that an output only appears at the AND gate 50 if there is a positive input to the shift register 48 and each one of the twenty bits of the shift register 42 is also positive; in other words if the particle extends over a distance of at least two channel widths to one side of the point at which the surface characteristic is detected. Similarly an output appears at the AND gate 52 when the last ten bits in the shift register 42 are positive and the tenth bit in the shift register 48 is also positive. This corresponds to the situation when a desirable surface feature occurs at least one channel width from a boundary of an ore particle. If a positive output does not appear at either of the AND gates 50 or 52 and a desirable surface feature is in fact present the flip flop 58 is only triggered when a positive pulse appears at the output of the shift register 48.

The flip flop is thus triggered by the detection of a surface feature on a small particle or by the detection of a surface feature at a point on a particle at least one channel width away from the boundary of the particle or by the detection of a surface feature at a point on a particle at least two channel widths away from a boundary of the particle. In the latter cases the flip flop output which corresponds to a treated form of the data input to the shift register 48 is employed to attribute the presence of the surface feature to a portion of the particle extending one channel width and two channel widths respectively in one direction from the point at which the feature was detected. The flip flop output is maintained positive until triggered by a positive signal appearing on its other input. This positive signal only appears when all data has been moved out of the shift register 42. In other words the flip flop is triggered by the absence of any bits in the shift register, a condition occurring when the optical system has scanned a particle and come to a boundary of the particle.

The apparatus of FIG. 5 by its technique of delay and comparison therefore has the function of attributing the presence of a desirable surface feature to all those channels on one side of the point at which the feature is detected and into which the particle extends and on the other side of this point of attributing the surface feature to the particle for one or two channel widths depending on the size of the particle in that direction.

The analyser 76 then responds as if the feature were actually present in practically all the channels into which the particle extends and the corresponding nozzles are then actuated to force the particle into the collecting bin. Similarly with the case illustrated in FIG. 4 where two desirable contrasting features are present in different channels the attribution of these features to practically all the other channels means that the detecting circuitry will respond to the two features as if they were present in each channel. The particle is therefore selected and a sufficient number of air nozzles is actuated to force the particle into the collecting bin.

Clearly, by extending the shift register 42 the surface feature can be attributed to more than two channels as desired.

The increased efficiency offered by the invention is significant. In a test run with a conventional machine a 20% ore loss was recorded on a contrast sort which was based on the detection of at least two different features. The invention, because of its ability to extend the contrast comparison to a number of channels, reduced the ore loss to 4%.

I claim:

1. In a method of sorting objects which includes the steps of passing each object through an area divided into zones and examining the object for a predetermined characteristic in each of the zones into which the object extends, the improvement of quantizing each zone into a predetermined number of spaced regions, generating a first series of signals corresponding to the regions into which the object extends, generating a second series of signals corresponding to the regions in which the predetermined characteristic is detected, and comparing the two sets of signals to produce a reference signal for attributing the characteristic to predetermined regions into which the object extends.

2. A method according to claim 1 in which the detected characteristic is attributed to the object in the regions of a first zone into which the object extends and which is continguous the zone in which the characteristic is detected.

3. A method according to claim 2 in which the detected characteristic is attributed to the object in the regions of the first zone which lies on a first side of the zone in which the characteristic is detected, when the distance between at least one point on the object in the first zone and the point at which the characteristic is detected exceeds a predetermined amount.

4. A method according to claim 2 in which the detected characteristic is attributed to the object in the regions of all zones into which the object extends on a second side of the zone in which the characteristic is detected.

5. Apparatus for sorting objects wherein each object is passed through an area divided into a predetermined number of spaced regions and examined for a predetermined characteristic in each of the regions, the apparatus comprising means for generating a first series of signals corresponding to the regions into which the object extends, means for generating a second series of signals corresponding to the regions in which the predetermined characteristic is detected, means for comparing the two sets of signals to produce a reference signal, and means responsive to the reference signal for attributing the characteristic to predetermined regions into which the object extends.

6. Apparatus according to claim 5 in which the comparison means comprises first shift register means for recording the first series of signals, second shift register means for recording the second series of signals, and AND gate means connected to the first and second shift register means for producing the reference signal.

7. Apparatus according to claim 6 in which the attributing means comprises bistable switching means adapted to be switched to one mode upon detection of a predetermined characteristic and to be switched to a second mode when the first series of signals indicates the object does not extend into the spaced regions.

8. In a method of sorting objects which includes the steps of passing each object through an area divided into zones and examining the object for a predetermined characteristic in each of the zones into which the object extends, the improvement of characterizing the object when a characteristic is detected by attributing the detected characteristic to the object in a first zone which lies on a first side of the zone in which the characteristic is detected when the distance between at least one point on the object in the first zone and the point at which the characteristic is detected exceeds a predetermined amount, and attributing the characteristic to the object for all zones into which the object extends on a second side of the zone in which the characteristic is detected.

9. Apparatus for sorting objects wherein each object is passed through an area divided into zones and examined for a predetermined characteristic in each of the zones into which the object extends which comprises means for examining the object in each of the zones into which it extends for at least one predetermined characteristic, means for determining the distance between the point at which the characteristic is detected and at least one point on the object in a zone which lies on a first side of the zone in which the characteristic is detected, and means for extending the characteristic to the object in that zone when the distance exceeds a predetermined amount, and for extending the characteristic to the object for all zones into which the object extends on a second side of the zone in which the characteristic is detected.

* * * * *